United States Patent [19]

Saylor et al.

[11] Patent Number: 4,815,215

[45] Date of Patent: Mar. 28, 1989

[54] UNIVERSAL HOLDING FIXTURE WITH TEMPLATES FOR ROUTING DOOR AND DOOR JAMBS

[76] Inventors: Millard P. Saylor, 1125 W. Greenbrier Ct., Arlington Heights, Ill. 60004; Richard Rickert, 809 S. Chestnut Ave., Arlington Heights, Ill. 60005

[21] Appl. No.: 95,613

[22] Filed: Sep. 10, 1987

[51] Int. Cl.[4] ..... E05B 17/06

[52] U.S. Cl. ..... 33/197; 33/562; 33/638; 33/613; 33/644; 144/144.5 R

[58] Field of Search ..... 33/197, 628, 630, 638, 33/644, 645, 667, 670, 673, 676, 562, 520, 613, 623; 144/144 R, 144.5 R, 144.5 GT, 27

[56] References Cited

U.S. PATENT DOCUMENTS

| | | | |
|---|---|---|---|
| 1,233,458 | 7/1917 | Fisk | 33/676 |
| 2,370,017 | 2/1945 | Delvaux | 33/644 |
| 2,427,081 | 9/1947 | Zern | 144/27 |
| 2,809,440 | 10/1957 | Schlage | 144/27 |
| 2,832,154 | 4/1958 | Bauer | 144/27 |
| 3,150,452 | 9/1964 | Meuwissen | 33/197 |
| 3,789,892 | 2/1974 | Converse et al. | 33/197 |
| 4,306,823 | 12/1981 | Nashlund | 33/197 |
| 4,392,307 | 7/1983 | Wightman, Jr. | 33/197 |

*Primary Examiner*—William A. Cuchlinski, Jr.
*Assistant Examiner*—Patrick R. Scanlon
*Attorney, Agent, or Firm*—Edward D. Gilhooly

[57] ABSTRACT

A universal holding fixture with integrated templates for routing recess slots in doors for lock plates and door jambs for strike plates. The fixture includes a clamping mechanism allowing attachment to various widths of jambs and doors and is capable of compensation for irregularities and levels on the doors or jambs. The fixture provides two support bars to guide and control the router motor base for ease of operation and accurate control of recess depth. A depressible locating pin achieves accurate centering of lock plate with door lock bolt.

13 Claims, 4 Drawing Sheets

UNIVERSAL HOLDING FIXTURE WITH TEMPLATES FOR ROUTING DOOR AND DOOR JAMBS

BACKGROUND OF THE INVENTION

1. Field of the Invention

The present invention generally relates to a fixture for routing doors and door jambs and, more particularly, to a universal fixture useable with a plurality of templates for routing recess slots in doors for lock plates and door jambs for strike plates.

2. Description of the Prior Art

During the installations of doors, it is necessary to create slots in the door and door jambs to attach respectively lock plates and strike plates for the latch or lock mechanism. Several designs of fixtures have been developed to facilitate cutting of the requisite slots using power routers or chisels. Known fixtures have been deficient in providing a technique by which precision cuts can be made for a large range of sizes and shapes of doors and jambs. Prior fixtures have required numerous adjustments for attachment that can lead to misalignment or irregular slots and possible damage to the doors and/or door jambs.

None of the previous fixtures can effectively accomodate varying widths and slopes of doors and jambs with ease and resulting accuracy of cut. An example of a prior jig for guiding routers is disclosed in U.S. Pat. No. 3,559,704 to W. H. Thompson dated Feb. 2, 1971. Among many shortcomings of the jig shown in the Thompson patent, the fixture fails to permit accurate and convenient attachment and to compensate for irregularities in shape, size, and surface planes of the door or jamb. Similar deficiencies are present in the jig illustrated in U.S. Pat. No. 3,150,452 to E. P. Meuwissen issued Sept. 29, 1964, and the lock installation device disclosed in U.S. Pat. No. 4,445,277 to J. Keefe issued May 1, 1984. Moreover, none of the prior art devices, including the jigs or fixtures disclosed in foregoing patents, include means to accurately position a template in relationship to the bolt hole of a door.

SUMMARY OF THE INVENTION

It is an objective of the invention to provide an inexpensive and convenient fixture for precise routing of slots for lock plates in doors and strike plates in door jambs. The fixture is intended to locate and mount one of a plurality of templates without individual adjustments at a fixed position for routing of the door or jamb. Each of the templates is designed to fulfill specific slot requirements and is selectively mounted and properly located at fixed mounting points on the fixture herein disclosed.

A universal type clamping means of the invention insures accurate placement of the fixture and template in relation to beveled surfaces and to other irregular shapes. A single adjustment facilitates attachment of the fixture to a wide range of thicknesses of doors and/or jambs and eliminates other operable variables, required in prior art devices, that may cause costly errors.

The fixture provides a unique technique for guaranteeing a proper depth of cut by the router. A novel centering means used with the fixture of the invention insures that the slot for the lock plate is precisely oriented with the bolt hole of the door. Solid spacers provide proper spacing of the fixture and template to maintain level and proper depth recesses for the lock plates and strike plates. Auxiliary non-removable spacers are movably mounted to aid in proper fixture placement for a wide range of shapes, widths and thicknesses of doors and door jambs.

The fixture of the invention is simple to use, reduces operational costs and eliminates possible errors or damage causing product loss.

DESCRIPTION OF THE PREFERRED EMBODIMENT

Figures 1, 2, 3, 4:
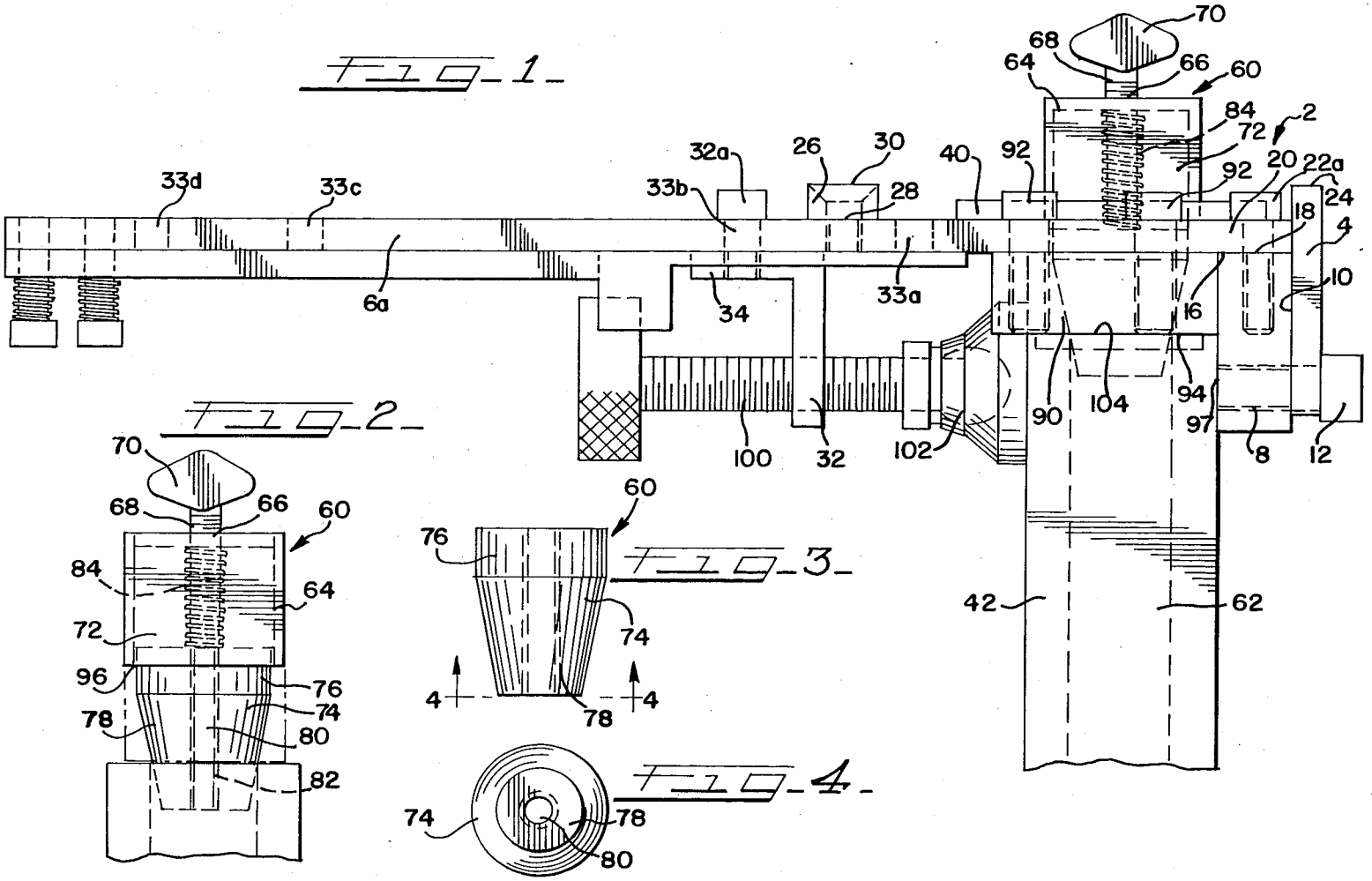
FIG. 1 is a side elevational view of the universal holding fixture of the invention being affixed on a door positioning a door lock plate template in proper alignment to a bolt lock.
FIG. 2 is a side elevational view of the universal center device of the invention used to align universal holding fixture of FIG. 1 with a bolt hole.
FIG. 3 is a side elevational view of the tapered centering pin of the universal centering device of FIG. 2.
FIG. 4 is a top plan view of the universal centering device of FIG. 3 viewed from the centering pin.

Referring to FIGS. 1,5,6,7, and 8, there is shown the universal positioning fixture of the invention, generally designated by reference numeral 2. The fixture 2 is shown employing three different templates (to be described) for either routing the lock plate of a door or the strike plate of a door jamb or an outside door jamb as will be apparent. The fixture 2 is capable of supporting a large number of templates at proper position for the varying sizes and configurations of lock plates and strike plates as needed.

As seen in FIGS. 1,5,6,7, and 8, the fixture 2 is fabricated from a suitable metal, such as steel or aluminum. The fixture 2 includes a flat base 4 and a pair of parallel legs 6*a* and 6*b*. A pair of blocks 8 are affixed to opposite sides of face 10 of base 4 by respective threaded members 12. The top edges 16 of block 8 are cut away at area 18 to receive an end portion 20 of legs 6*a* and 6*b* and create contact between two perpendicular surfaces of the legs 6*a* and 6*b* and blocks 8. A pair of threaded members 22*a* and 22*b* respectively extend through legs 6*a* and 6*b* to retain the legs to the base 4 in perpendicular orientation to face 10.

The blocks 8 are mounted on base 4 in a manner to position the edge 24 of base 4 beyond the top of threaded members 22*a* and 22*b* so that edge 24 can function as a continuous rail for a routing motor. A cross member 26 is affixed at each end to legs 6*a* and 6*b* by threaded members 28. The cross member 26 not only strengthens the fixture 2, but includes a rail surface 30 lying in the same plane as edge 24 to also function as a rail for a routing motor.

A plate 32 is removably mounted beneath a lower side of legs 6*a* and 6*b* at one of a plurality of positions in FIG. 1, 5, and 6 as will be described. A pair of threaded members 32*a* may removably attach the plate 32 to a corresponding pairs of holes 33*a, b, c,* and *d* formed in legs 6*a* and 6*b*. A pair of integral projections 34 are formed on plate 32 to which threaded members 32*a* are affixed to the plate 32 through legs 6*a* and 6*b*.

Figure 9:
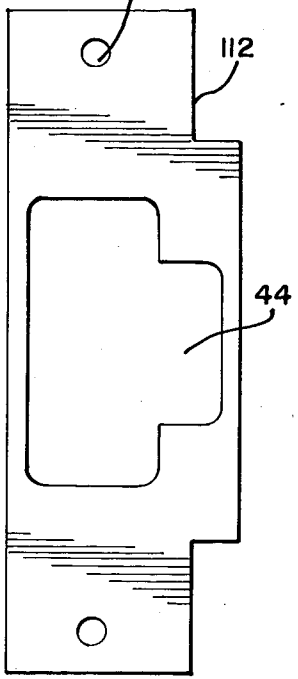
FIG. 9 is a top plan view of the template shown in FIG. 5.
Figure 7:
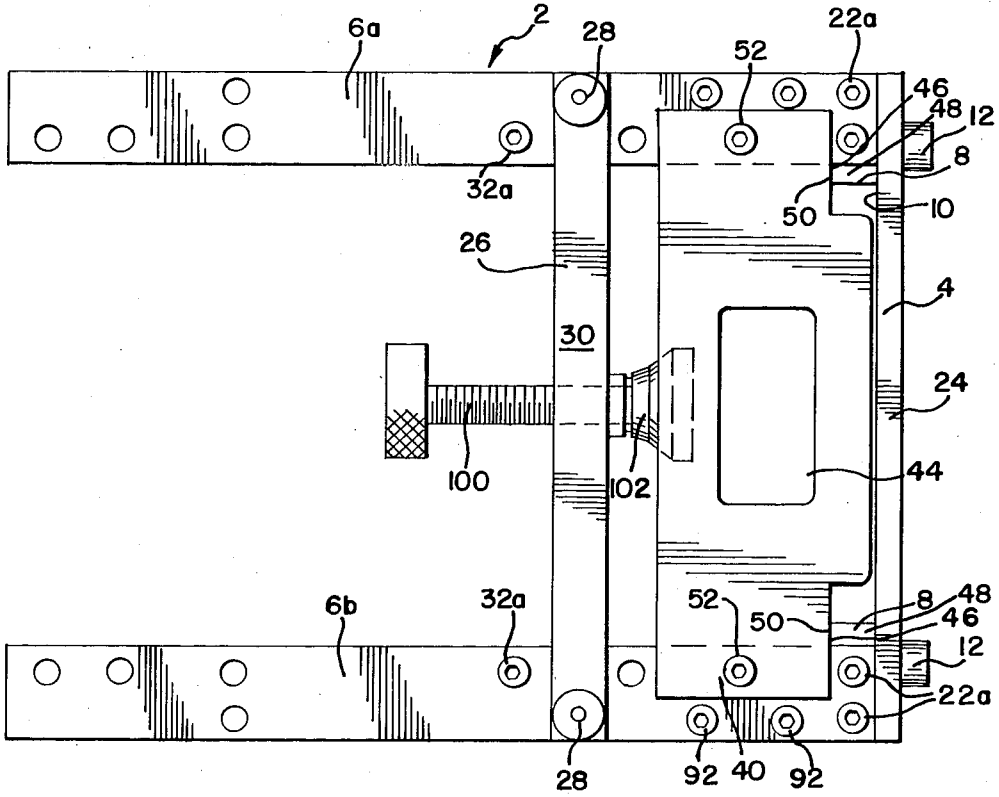
FIG. 7 is a top plan view of the universal holding fixture of FIG. 1 supporting the template as shown in FIG. 1.
Figure 8:
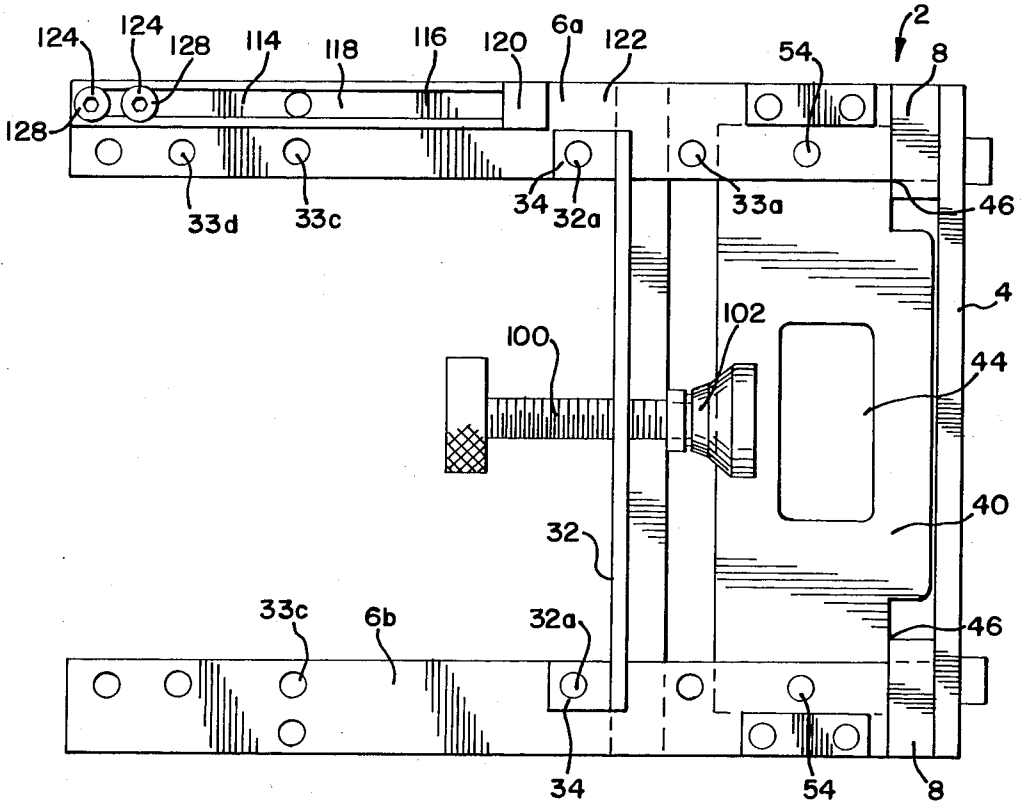
FIG. 8 is a bottom plan view of the universal holding fixture of FIG. 1 supporting the template of FIG. 1.

Referring to FIG. 1 a template 40 is designed to be positioned on legs 6*a* and 6*b* between the routing motor rails created by edge 24 and surface 30 of cross member 26. The fixture 2 is shown in FIG. 1 attached to a door 42, and template 40, mounted for routing a door lock plate, is shown in FIG. 9. The template has an opening 44 having the shape of the lock plate which is to be attached to door 42. The template 40 is formed with cut-out areas 46 on one side at each end. An edge portion 48 of blocks 8 project above legs 6*a* and 6*b* so that a side surface 50 abuts against a portion of template 40 at cut-out areas 46 to aid in positioning of the template. In FIGS. 7 and 8, an elevational view of the template 40 mounted on fixture 2 is illustrated. Template 40 is shown being attached to the legs 6*a* and 6*b* by removeable threaded members 52. The threaded members 52 pass through mounting holes 54 on template 40 (FIG. 9) and corresponding holes in legs 6*a* and 6*b* that orient the template in proper position on the fixture. A multiplicity of templates having the same overall configuration and mounting holes, but with different centerlines for template routing openings, may be selectively attached to fixture 2 by threaded members 52. Different centerlines of template openings may be required for varying thickness of doors or jambs, but the mounting holes 54 of all templates are at the same location. The routing opening of an individual template may include different shapes and sizes dependent on whether used for routing door plates or strike plates, and on the particular configuration of the strike plates or lock plates being affixed to a door or jamb. Thus, fixture 2 is universal in the sense that it can accept and properly position a plurality of special templates.

Referring to FIGS. 1 to 4, there is shown a universal centering device 60 that is used in conjunction with template 40 for routing the lock plates of door 42. The centering device 60 is intended to locate and properly position the fixture 2 with respect to a predrilled lock bolt hole 62 in door 42 in a direction along the length of the door edge in which bolt hole 82 is drilled. The centering device 60 insures that the template routing opening 44 is precisely positioned relative to the door lock bolt hole 62 to rout a proper lock plate slot without error. The centering device 60 includes a block 64 having an exterior configuration to match template opening 44. An unthreaded hole 66 through block 64 receives a thumb screw 68 projecting through an enlarged cylindrical open cavity 72 formed in the bottom of block 64.

A locator pin 74 having a upper cylindrical portion 76 and a lower tapered or conical end portion 78 is received in cavity 72. The end 80 of thumb screw 68 extends into threaded hole 82 in pin 74. A spring 84 is carried by thumb screw 68 in cavity 72 between the block 64 and the top of locator pin 74 to provide a resilient bias between the two members.

In use of the fixture 2 to rout lock plates as in FIGS. 1 and 7, the template 40 is affixed to fixture 2 as previously described. The fixture is positioned adjacent to the bolt hole 62 of door 42. The fixture 2 is provided with a pair of fixed spacers 90 respectively affixed by threaded members 92 to legs 6*a* and 6*b*. The bottom edges 94 of spacers 90 space the legs 6*a* and 6*b* and template 40 at a predetermined distance from the door edge 82. The locator pin of the centering device 60 is placed through opening 44 to be forced into door lock bolt hole 62 while the block 64 is positioned within the opening 44. The tapered end 78 of the spring biased and depressible locator pin 74 centers itself while being forced into the bolt hole 62. By locating the conical end 78 of locator pin 74 in the bolt hole 62, the block 64 centers the fixture 2 and template 40 in accurate relationship to the bolt hole for error free routing of the lock plate recess. The locating device 60 then acts to square the fixture 2 and template 40 on door 42. In carrying out the foregoing procedure, the block 64 is pressed to the door with bottom surface 96 of the block 64 bearing against the door 42, while sides 97 of blocks 8 bear against a face of the door. The surface 97 provides alignment of the centerline of the template opening 44 laterally across the door edge. The spring 84 and cavity 72 permit the block 64 to be pressed down relative to pin 74.

In FIG. 1, the plate 32 is affixed in opposed holes 33*b* by threaded members connecting the ends to angled sections 34. The selected position of plate 32 is dictated by the width of the door or jamb to which the fixture is to be attached. A threaded thumb screw 100 extends through plate 32. The opposite end of the shaft is provided with conventional ball socket swivel 102. The swivel 102 is clamped to the door 42 after centering so that a routing operation can be performed. The swivel 102 allows proper attachment of the fixture 2, even if the door edge 104 possesses a beveled shape as is common for known configurations. After clamping, the centering device 60 is removed from template 40. The use of thumb screw 100 to clamp fixture 2 to door 42 allows the fixture to be easily attached to a range of widths of doors without changing the position of plate 32.

The door plate recess can then be cut by running a router motor housing along the continuous rails created by edge 24 and cross member surface 30. Prior to cutting, the lock plate to be installed on door 42 can be placed between the rails 24 and 30 and the base of the router motor (not shown). The router cutter blade is adjusted until it is flush with the door edge 104. By removing the lock plate before routing, the cutter will be guided by rails 24 and 30 to form a lock plate recess of proper depth. The same procedure for establishing the router cut can be accomplished in cutting strike plate recesses.

Figure 5:
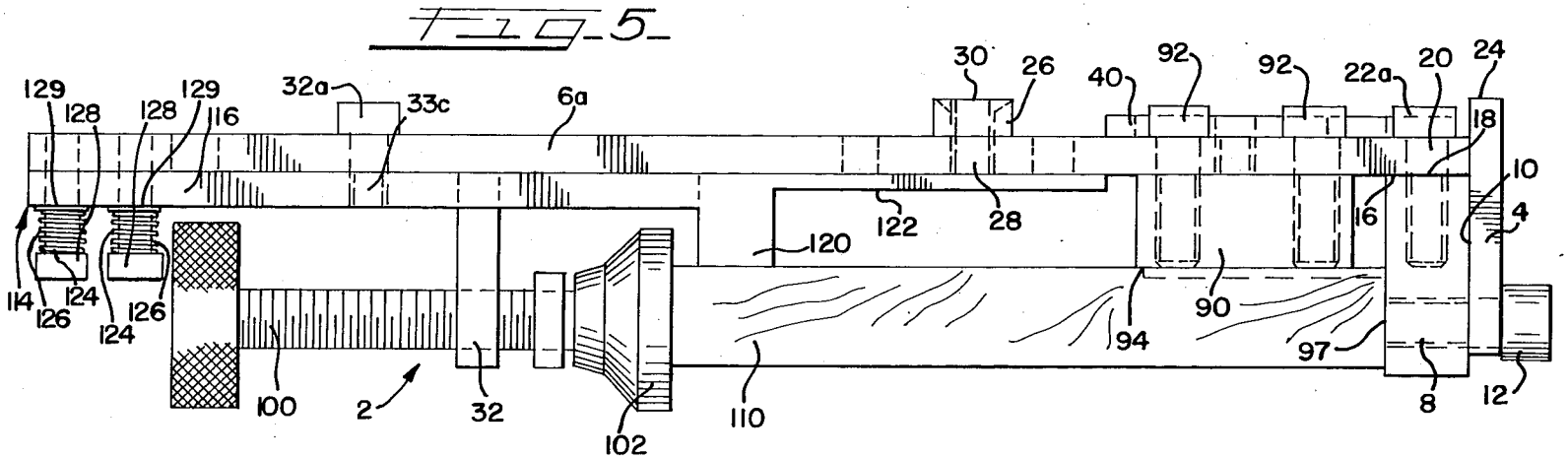
FIG. 5 is a side elevational view of the universal holding fixture of FIG. 1 in position on a inside door jamb and supporting a template for routing the jamb for a strike plate.

Referring to FIG. 5 and 9, there is illustrated the fixture 2 of the invention in position on an inside door jamb 110 to rout a strike plate recess. Because of the width of the door jamb, the plate 32 is moved to a different position, such as in holes 33*c*, for clamping of the fixture. The configuration of template 112 for the strike plate is shown in FIG. 9. The template 112 is attached and used in the manner as previously described with reference to FIG. 1, but without the centering device 60. A further adjustable, but non-removeable spacer assembly 114, not used with the door of FIG. 1, insures proper positioning and squaring of the fixture 2 prior to clamping on the door jamb between swivel 102 and block surface 97. The spacer assembly 114 includes an elongated member 116 lying in flat relationship to a portion of leg 6a. As best seen in FIG. 8, the member 116 is provided with a closed slot 118 and an adjustable spacer block 120 projecting down at the internal end of the slot 118. The oppposite side of the slot 118 from spacer 120 forms a second spacer or another surface 122. A pair of connecting elements 124 are positioned in slot 106 and are affixed to leg 6a.

A compression spring 126 is mounted on each member 124 between the member 116 and an enlarged head 128 of the connecting element 124. An enlarged washer 129 is positioned at the end of the spring 126 against the elongated member 116. The resiliency of the spring 126 allows the elongated member 116 to be shifted relative to leg 6a, hence spacer 120 can be moved as desired to insure contact with the door jamb 110. The spacer blocks 90, surface 97 of blocks 8 and adjustable block 120 square the fixture 2 for routing to be performed in a manner previously described.

Figure 6:
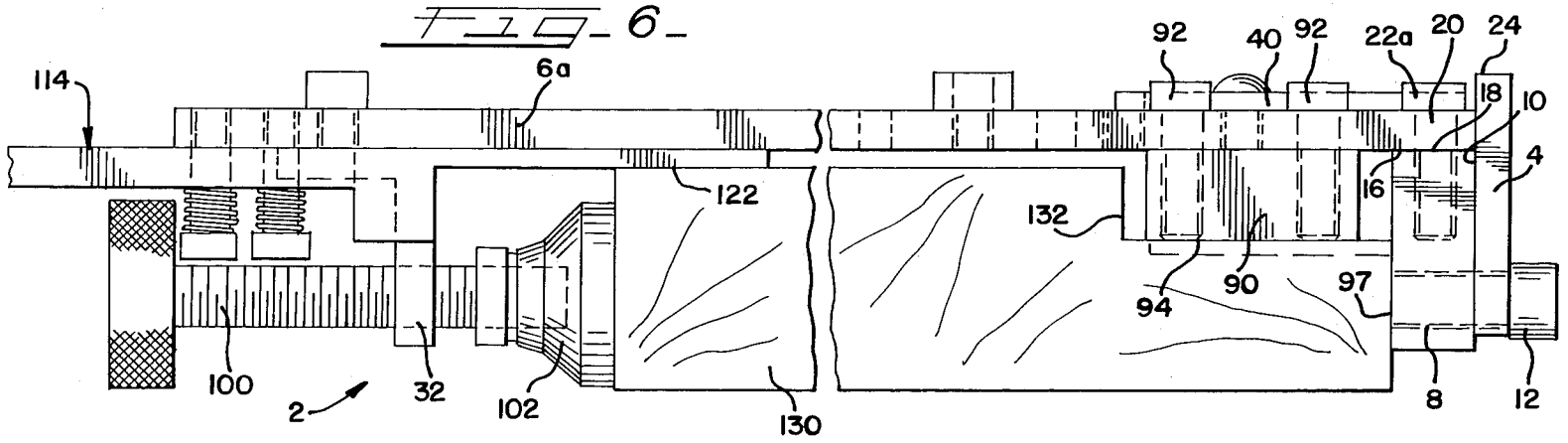
FIG. 6 is a side elevational view of the universal holding fixture of FIG. 1 positioned on an outside door jamb and supporting a template for door jamb being routed for a strike plate.
Figure 10:
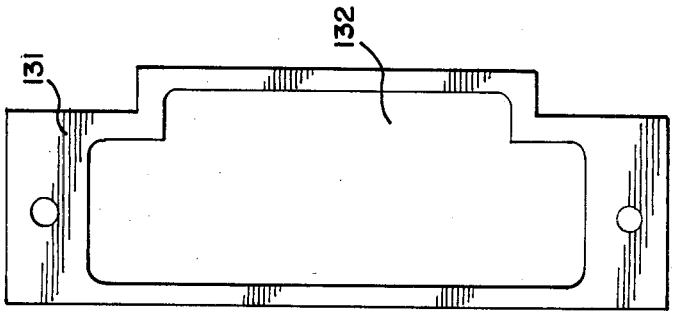
FIG. 10 is a top plan view of the template shown in FIG. 6.

Referring to FIGS. 6 and 10 there is illustrated the fixture 2 positioned on a typical outside door jamb 130 using template 131. The fixture accomodates the cut-out section 132 of the jamb 130 by the positioning of the spacer blocks 90 and surface 97 in the manner in FIG. 6. The block 120 is moved away from the surface of the jamb 130, and the surface 122 of member 106 bears against the jamb as support and squaring means. The strike plate to be installed can be used as a depth gauge before routing in the manner described with reference to the lock plate in FIG. 1. It should be apparent that the arrangement of various spacers as previously described also permits the fixture 2 to be used with other configurations and sizes of doors and jambs then specifically as shown. The adjustability of thumb screw 100 at each selected position of plate 32 allows the fixture to be attached to a range of thicknesses of doors and jambs without changing the plate position.

What is claimed is:

1. A holding fixture assembly for positioning templates adjacent to doors and door jambs for routing recesses for lock plates and strike plates comprising:

a base and a pair of spaced legs affixed to said base, said spaced legs being disposed perpendicular to said base, means attached to said legs and cooperating with said base to create a pair of rail surfaces for guiding the housing of a routing tool during routing of recesses, said pair of legs arranged to support one of a plurality of template plates having the same configuration and different openings, the template opening of said one of the plurality of template plates being supported between said rail surfaces at a position beneath said rail surfaces, spacer means affixed to said pair of legs to space said template plate a predetermined distance from said door or door jamb, clamp means for attaching said base and said pair of legs to the door or door jamb being routed, said clamp means including a surface to contact a surface of the door or door jamb being routed, and said clamp means further having a swivel end space from said surface of said clamp means and acting to contact an opposed surface of the door or door jamb being routed to orient said template plate in a squared relationship with the surface being routed during attachment.

2. The holding fixture assembly according to claim 1 wherein said swivel end is mounted on a ball joint.

3. The holding fixture assembly according to claim 1 wherein said spacer means are a pair of spaced blocks having a pair of surfaces arranged to contact the surface of the door or door jamb being routed during attachment of said base and said pair of legs by said clamp means.

4. The holding fixture assembly according to claim 3 wherein said base includes a surface portion in contact with another surface of the door or door jamb during attachment.

5. The holding fixture assembly according to claim 1 further comprising a separable bolt hole locater to position one of said plurality of template plates being supported by said pair of legs in proper alignment with a predrilled bolt hole in a door for routing a lock plate recess, said bolt hole locater having an upper portion formed with an exterior configuration matching the template opening of said one of said plurality of said template plates, said upper portion being arranged to be inserted into the template opening prior to attachment of said base and said pair of legs to the door, said bolt hole locater further having a lower portion having a conical end arranged to be inserted into the predrilled bolt hole and orient said template opening in proper relationship above said bolt hole.

6. The holding fixture assembly according to claim 5 wherein said upper portion of said bolt hole locater device is a block having a configuration matching said template opening, said conical end being resiliently biased to said block.

7. The holding fixture assembly according to claim 1 wherein said swivel end of said clamp means is affixed to the end of a thumb screw, said thumb screw being adjustably mounted on a plate affixed to said pair of legs.

8. The holding fixture assembly according to claim 7 further including means to adjustably attach said plate at a plurality of positions on said pair of legs.

9. A centering device for positioning a routing fixture having a template opening adjacent to a bolt hole for cutting a lock plate recess in a door comprising:

a block having an exterior configuration matching the template opening, an end portion having a conical end operably affixed to said block and arranged to be inserted into the bolt hole, a threaded member extending through said block and attached to said conical end, said block being insertable into the template opening and said conical end portion being insertable into bolt hole, said block acting to center the template opening relative to the bolt hole after insertion of the conical end into the bolt hole, spring means mounted between said block and conical end to resiliently bias said conical end into the bolt hole, said block being arranged to be pressed against the door over a portion of said end portion after centering with said conical end in the bolt hole for squaring the routing fixture for cutting a lock plate recess.

10. A holding fixture for positioning templates adjacent to doors and door jambs for routing recesses for lock plates and strike plates comprising:

a base and a pair of spaced legs affixed to said base, said spaced legs being disposed in perpendicular direction to said base, means attached to said legs and cooperating with said base to create a pair of rail surfaces, said pair of legs arranged to support a template plate having a template opening between said rail surfaces, fixed spacer means affixed at a fixed position to said pair of legs to space said template plate a predetermined distance from the door or door jamb, clamp means for attaching said base and said pair of legs to the door or door jamb being routed, and moveable spacer means being mounted on one of said spaced legs for selective movement in said perpendicular direction, said moveable spacer means having a spacer surface for selectively supporting said one of said spaced legs on the surface of a door jamb being routed.

11. The holding fixture according to claim 10 wherein said moveable spacer means includes an elongated member affixed to one of said legs, said elongated member having a slot, means disposed in said slot attaching said elongated member to said one of said legs and permitting movement of said elongated member, a spacer block mounted on said elongated member and forming said surface to support said one of said legs on a surface of a door jamb, and said elongated member being moveable relative to said one of said legs to vary the position of said surface of said spacer block relative to a surface of the door jamb.

12. The holding fixture according to claim 11 wherein said elongated member further includes a support surface adjacent to said slot, said support surface acting to contact a door jamb when said surface of said moveable spacer block is moved to a position out of contact with the door jamb.

13. The holding fixture according to claim 10 wherein said moveable spacer means includes a second surface arranged to support said one of said spaced legs on the door jamb when said spacer surface is moved in said perpendicular direction out of contact with the surface of the door jamb.

* * * * *